US008060000B2

(12) United States Patent
Halfyard et al.

(10) Patent No.: US 8,060,000 B2
(45) Date of Patent: Nov. 15, 2011

(54) TECHNIQUE AND SYSTEM FOR REDUCING CONTAMINATION BUILD-UP ON FUSER ROLL BY REDUCTION OF STATIC CHARGE BUILD-UP IN IGEN3 FUSER SUBSYSTEM

(75) Inventors: Kurt I. Halfyard, Mississauga (CA); Nicoleta Mihai, Oakville (CA); Brian McAneney, Burlington (CA); Fernando Perez Yulo, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 507 days.

(21) Appl. No.: 12/367,769

(22) Filed: Feb. 9, 2009

(65) Prior Publication Data

US 2010/0202807 A1 Aug. 12, 2010

(51) Int. Cl.
*G03G 15/20* (2006.01)

(52) U.S. Cl. ..... 399/325

(58) Field of Classification Search ..... 399/325
See application file for complete search history.

*Primary Examiner* — David Gray
*Assistant Examiner* — Ruth Labombard
(74) *Attorney, Agent, or Firm* — MH2 Technology Law Group LLP

(57) ABSTRACT

A method and system for reducing contamination build-up within a fuser roll system are disclosed. The method and system includes a donor roll in rotational combination with a fuser roll. The donor roll can be configured to transfer a toner release agent to the fuser roll to reduce toner build-up on the surface of the fuser roll. A grounded static brush can be located proximate to the donor roll. The grounded static brush can be configured to inductively remove electrostatic discharge from the surface of the donor roll. The reduced electrostatic reduces contamination build-up on the fuser roll, and therefore increases the cycle life of the components of the fuser roll system.

20 Claims, 4 Drawing Sheets

TECHNIQUE AND SYSTEM FOR REDUCING CONTAMINATION BUILD-UP ON FUSER ROLL BY REDUCTION OF STATIC CHARGE BUILD-UP IN IGEN3 FUSER SUBSYSTEM

FIELD OF THE INVENTION

This invention relates generally to an electrophotographic printing machine and, more particularly, to a fuser roll system including a static-eliminator brush assembly to reduce contamination.

BACKGROUND OF THE INVENTION

Electrostatic reproduction involves an electrostatically-formed latent image on a photoconductive member, or photoreceptor. The latent image is developed by bringing charged developer materials into contact with the photoconductive member. The developer materials can include two-component developer materials including carder particles and charged toner particles for such as "hybrid scavengeless development" having an image-on-image development. The developer materials can also include single-component developer materials including only toner particles. The toner particles are transferred to the photoconductive member from a toner cloud generated during the development process.

The toned image on the photoconductive member is advanced to a transfer station where an image-receiving substrate such as a sheet of paper is moved into contact with the photoconductive member to transfer the image via any suitable process. The image-receiving substrate is then advanced to a fusing station to fix or fuse the toner material onto the image-receiving substrate permanently by heat.

Conventional fusing stations include a fuser roll and a pressure roll to fuse the toner to the substrate. Over time, contamination can build up on the surface of the fuser roll. Specifically, toner resin build-up on the fuser roll from various forms of offset, gelled oil, pigment staining, and Zinc Fumarate, a byproduct of additives and toner resin. Further, the contamination can lead to a pigment building up on the fuser roll or penetration of the top-coat material.

Toner release agents can also be applied to the fuser roll to aid in the removal of toner from the fuser roll. The toner release agents can be comprised of conventional substances and can be applied by way of a donor roll. The configuration and materials of the donor and fuser rolls can lead to an accumulation of an electrostatic charge in the fuser roll system, specifically on the donor roll. The accumulation can exacerbate the build-up of the toner resin, the pigment, and other forms of contamination on the surface of the fuser roll over the life of the roll.

Thus, there is a need to overcome these and other problems of the prior art and to provide a system, method, and apparatus to reduce premature fuser roll failure by reducing the contamination build-up or rate of build up on the fuser roll.

SUMMARY OF THE INVENTION

In accordance with the present teachings, a method of reducing contamination build-up in a fuser roll system is provided. The exemplary method can include providing a donor roll and a fuser roll, wherein the donor roll is in rotational combination with the fuser roll. A grounded static brush configured to reduce contamination build-up by neutralizing a static charge on a surface of the donor roll can be positioned with a gap between the grounded static brush and the donor roll.

In accordance with the present teachings, a fusing station is provided. The exemplary fusing station can include a donor roll in rotational combination with a fuser roll. A grounded static brush configured to reduce contamination build-up by neutralizing a static charge on a surface of the donor roll can be positioned with a gap between the grounded static brush and the donor roll.

In accordance with the present teachings, a method of reducing contamination build-up in a fuser roll system is provided. The exemplary method can include receiving a toner release agent onto a donor roll in rotational combination with a fuser roll. The toner release agent can be transferred from the donor roll to the fuser roll. Contamination build-up can be reduced by discharging electrostatic charge from a surface of the donor roll with a grounded static brush, wherein the grounded static brush can be positioned with a gap between the grounded static brush and the donor roll.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

DESCRIPTION OF THE EMBODIMENTS

Reference will now be made in detail to the exemplary embodiments of the invention, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

Figure 1:
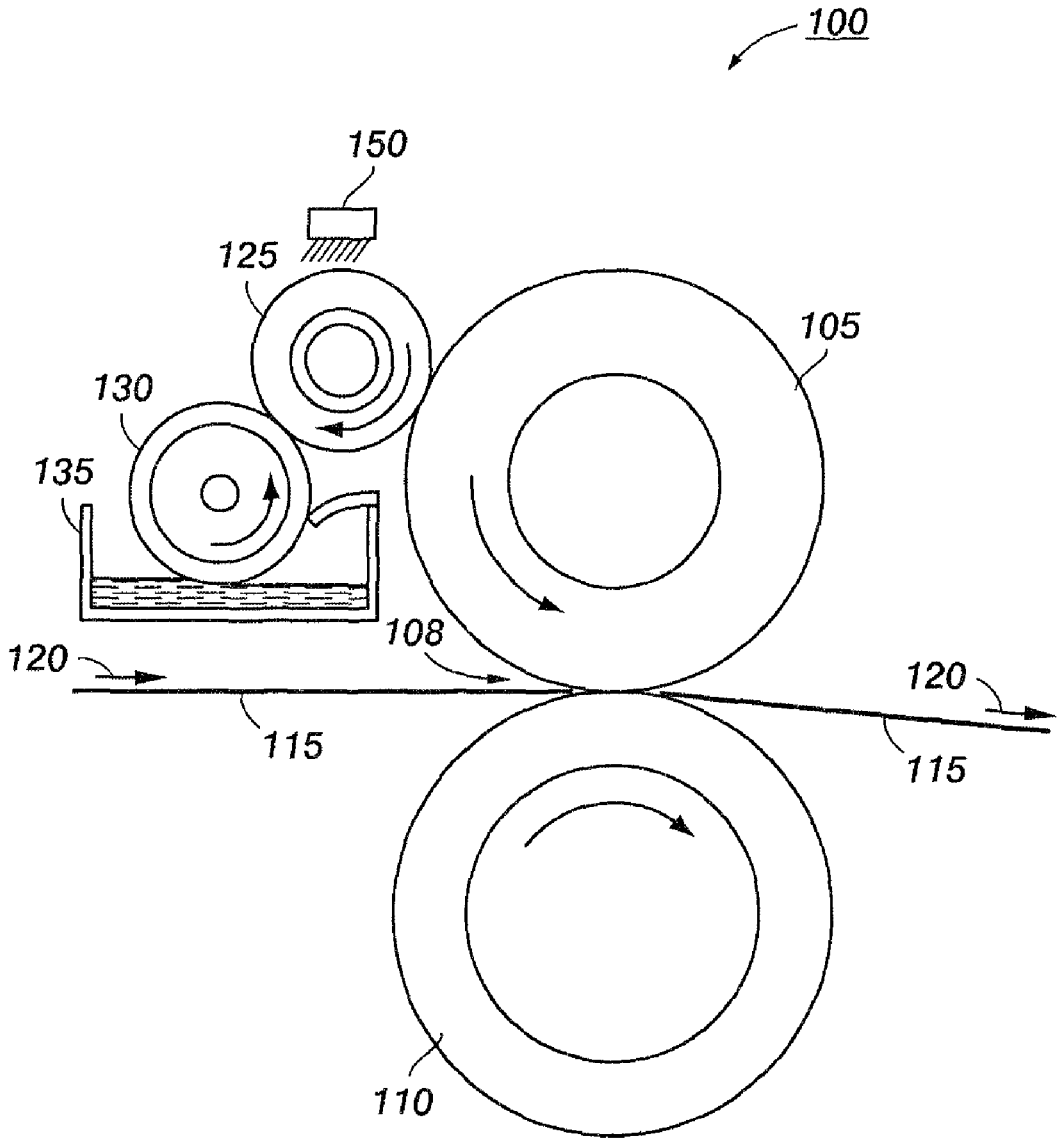
FIG. 1 depicts an exemplary method and system for reducing contamination build-up within a fuser roll system.

FIG. 1 depicts an exemplary method and system for reducing contamination build-up within a fuser roll system. The exemplary fuser roll system can be present in an electrostatographic imaging apparatus such as, for example, a laser printer.

In the present embodiments, a fusing station 100 can include a fuser roll 105, a pressure roll 110, and a substrate transport 115. The substrate transport 115 can direct an image-receiving substrate with a transferred toner powder image through a nip 108 between the fuser roll 105 and the pressure roll 110 along a direction indicated by an arrow 120. The arrows on the fuser roll 105 and the pressure roll 110 can indicate the rotational direction of each roll. The fuser roll 105 in rotational combination with the pressure roll 110 can permanently affix the transferred toner powder image to the image-receiving substrate. More specifically, the fuser roll 105 and the pressure roll 110 can press together when the substrate enters the nip 108 to provide enough pressure to fix the toner powder image to the substrate. The fuser roll 105 can also be capable of heating during the fusing process so that the toner material can coalesce and become tacky.

Through repeated cycles, the toner present on the image-receiving substrates can fail to penetrate the image-receiving substrate and can instead be transferred to and retained by the fuser roll 105. The tacktified toner material can stick to the fuser roll 105 and can come into contact with subsequent substrates that can pass through the fusing system 100. Also, the tacktified toner material can remain stuck to the fuser roll 105, and with successive substrates passing through the fusing system 100, the toner material can build up on the fuser roll 105. The toner build-up on the fuser roll 105 can, over time, lead to contamination of the fuser roll 105. As a result of the toner build-up and contamination, fumaric acid can build up on the surface of the fuser roll 105. The contamination can also lead to a pigment that can build up on the fuser roll 105 over time. The pigment can cause gloss defects in printing, and can also be visible on the surface of the fuser in various hues such as, for example, yellow, cyan, magenta, or other hues.

Further, zinc stearate can be used in some current toner formulations to provide stability and lubrication to the finished toner. However, the Zinc can react with the fumaric acid that has built up on the fuser roll 105 as a result of the toner contamination. The reaction can lead to Zinc fumarate precipitating on the fuser roll 105 and in the oil on the fuser roll 105, which can lead to print defects and premature development of offset.

The fusing system 100 can further include a donor roll 125, a metering roll 130, and a reservoir 135. The donor roll 125 and the metering roll 130 can be rotatably mounted in the direction indicated by the arrows. The donor roll 125 can be in rotational combination with the fuser roll 105, and the metering roll 130 can be in rotational combination with the donor roll 125. The reservoir 135 can hold a release agent which can be provided to the metering roll 130. The metering roll 130 can deliver the release agent to the surface of the donor roll 125. As the donor roll rotates in contact with the fuser roll 105, a thin film of the release agent on the donor roll 125 can be transferred to the fuser roll 105, with a thin portion of the release agent being retained on the donor roll 125.

The release agent can be comprised of conventional substances, such as, for example, silicone oils and polyorganosiloxane fluids. The release agent can be applied to the fuser roll 105 to aid in the removal of built-up toner and other contamination on the fuser roll 105. Although the release agent can aid in the removal of toner, the configuration and materials of the donor roll 125 and the fuser roll 105 can lead to an accumulation of an electrostatic charge in the fusing system 100, specifically on the donor roll 125. The accumulation can exacerbate the build-up of the toner resin, the pigment, and other forms of contamination on the surface of the fuser roll 105 over the life of the roll.

In present embodiments, a grounded static brush 150 can be provided in the fusing system 100. The grounded static brush 150 can have a static elimination capacity to discharge nearby static, similar to conventional static eliminator brushes. In preferred embodiments, the grounded static brush 150 can be positioned at a proximate distance from the donor roll 125. It should be appreciated that the grounded static brush 150 can be positioned at any location that enables the discharge of electrostatic charge in the fusing system 100.

Figure 2:
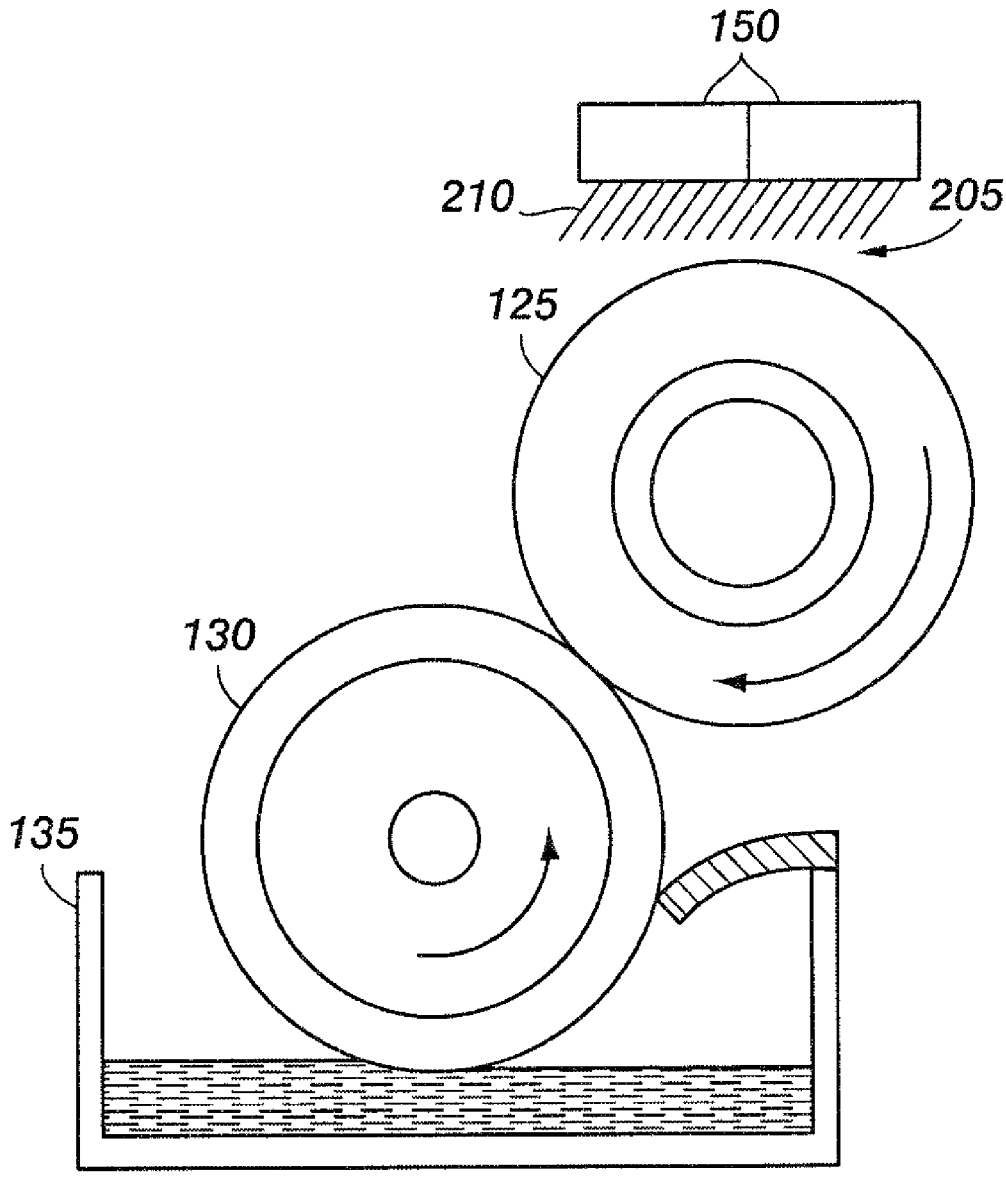
FIG. 2 depicts a detailed exemplary method and system for reducing contamination build-up within a fuser roll system.

FIG. 2 depicts a detailed view of an exemplary method and system for reducing contamination build-up within a fuser roll system. FIG. 2 includes one or more grounded static brushes 150 located at a proximate distance from the donor roll 125. The grounded static brushes 150 can each be a conventional grounded static brush such as, for example, the static-eliminator brush assembly existing in the iGen3 system.

Figure 3A:
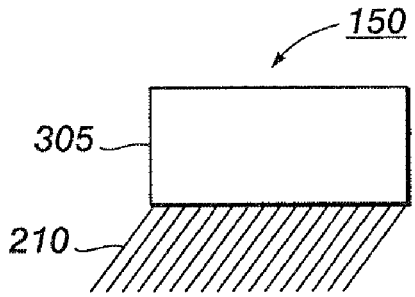
FIG. 3A depicts an exemplary grounded static brush.

Referring to FIG. 3A, an exemplary grounded static brush 150 is depicted. The grounded static brush 150 can be provided throughout the electrophotographic printing machine to reduce static charge at various points. The grounded static brush 150 can include a body 305 and brush fibers 210. The body 305 can be secured to or mounted within the electrophotographic printing machine, and specifically within the fusing system 100. The body 305 can house and secure the brush fibers 210. The brush fibers 210 can be configured to conduct a static charge. The brush fibers 210 can be composed of a conductive material such as, for example, carbon, conductive nylon, stainless steel, or any other conductive material The brush fibers 210 can have a diameter in the range of about 8-45 microns, but it should be appreciated that the brush fibers 210 can be smaller or larger depending on the components within the fusing system 100 or other factors. The brush fibers 210 can have varying brush densities depending on the type of grounded static brush 150, the type of body 305, and/or other factors.

Referring back to FIG. 2, electrostatic charge can build up within the fusing system 100 through repeated fusing cycles Specifically, the electrostatic charge can be a large negative charge on the surface of the donor roll 125. The electrostatic charge can build up from, among other things, a triboelectric effect of the donor roll 125 rubbing together with the fuser roll 105. Because the release agent on the surface of the donor roll 125 can be an inductor, the electrostatic charge can be staticly held to the surface of the donor roll 125 by the release agent. The electrostatic build-up on the surface of the donor roll 125 can exacerbate the build-up of the toner resin, the pigment, and other forms of contamination on the surface of the fuser roll 105 over the life of the roll.

Figure 3B:
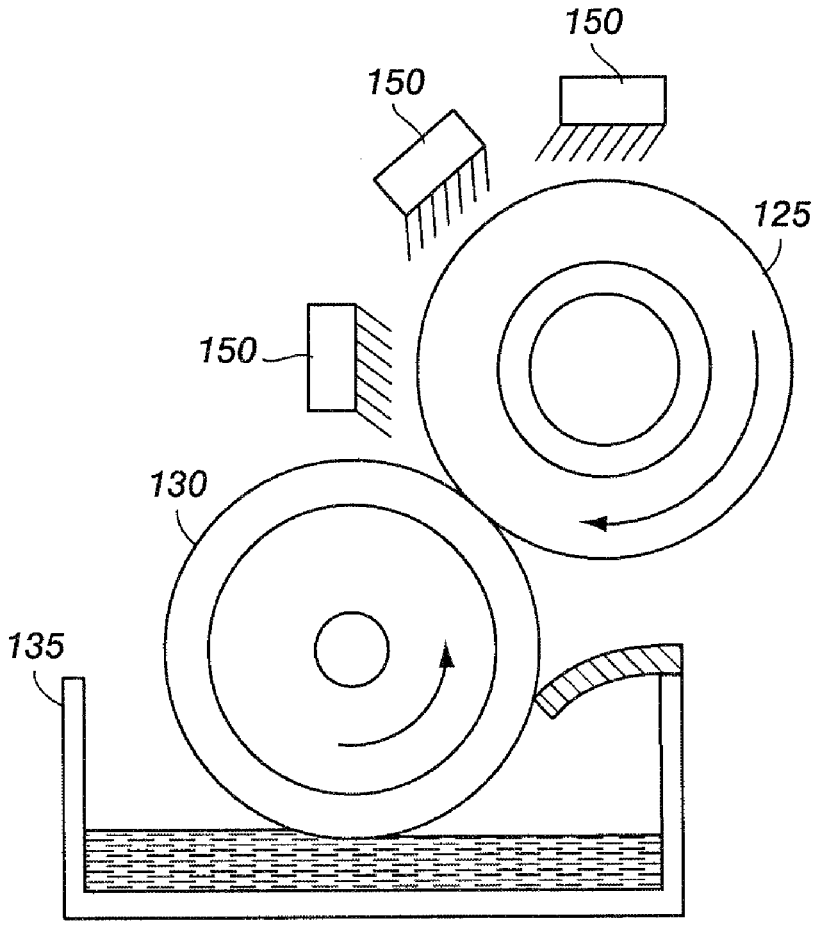
FIG. 3B depicts an exemplary embodiment of a fusing station.

The grounded static brush 150 can be mounted within the fusing system 100 via conventional means so that it is in close proximation with the donor roll 125. For example, as shown in FIG. 2, the grounded static brush 150 can be mounted above the donor roll 125. In embodiments, the grounded static brush 150 can be mounted on the sides or under the donor roll 125. In further embodiments, multiple grounded static brushes 150 can be mounted in separate locations surrounding the donor roll 125, as depicted in FIG. 3B. In still further embodiments, the grounded static brush 150 can be mounted in any location within the fusing system 100 where electrostatic charge exists such as, for example, near the fuser roll 105, the substrate transport 115, or any other component.

As shown in FIG. 2, the grounded static brush 150 can be positioned with a gap 205 between the donor roll 125 and the grounded static brush 150. The gap 205 can limit the release fluid present on the surface of the donor 125 from contacting and contaminating the grounded static brush 150. Further, the gap 205 can allow the grounded static brush 150 to inductively remove the static charge from the surface of the donor roll 125. The gap 205 can be, for example, in the range of about 1-20 millimeters. It should be appreciated, however, that the gap 205 can be smaller or larger depending on the components within the fusing system 100 or other factors In embodiments, one or more grounded static brushes 150 can be positioned adjacent to each other within the fusing system 100. For example, two grounded static brushes 150 can be employed to increase brush density. The grounded static brushes 150 can offset in such a way that there exists no gap between the grounded static brushes 150. Further, different size grounded static brushes 150 with different brush densities can be employed within the fusing system 100, and with any combinations thereof.

The electrostatic charge present on the surface of the donor roll 125 can be inductively held to the surface from the triboelectric effect of the donor roll 125 rubbing against the fuser roll 105. The electrostatic charge can further be held to the surface via the non-conductive release agent materials present on the surface. When the electrostatic charge is in close proximation to the conductive brush fibers 210 of the grounded static brush 150, the grounded static brush 150 can conduct the charge off the surface of the donor roll 125. As such, the grounded static brush 150 can effectively provide the electrostatic charge a path to the ground, allowing the charge to be neutralized.

The elimination of the electrostatic charge on the donor roll 125 can reduce the build-up of the toner resin, the pigment, and other forms of contamination on the surface of the fuser roll 105 over the life of the fuser roll 105. As a result, the fusing system 100 and the parts therein can have a greater cycle life.

In experiments conducted to test the amount of static charge on the surface of the donor roll, the results showed that the use of a grounded static brush reduced the amount of static charge as compared to test cases without the grounded static brush. The measurements from the specific experiments were taken after about 5,000 impressions of the fuser roll system. In test cases without the grounded static brush, the measured voltage at the donor roll varied from about −1,200 Volts to about −1,800 Volts. In contrast, in test cases employing the grounded static brush positioned near the donor roll, the measured voltage at the donor roll was about −300 Volts. Accordingly, the test cases employing the grounded static brush reduced the measured voltage at the donor roll by range of about 900 Volts to about 1,500 Volts compared to the test cases without the grounded static brush.

Figure 4:
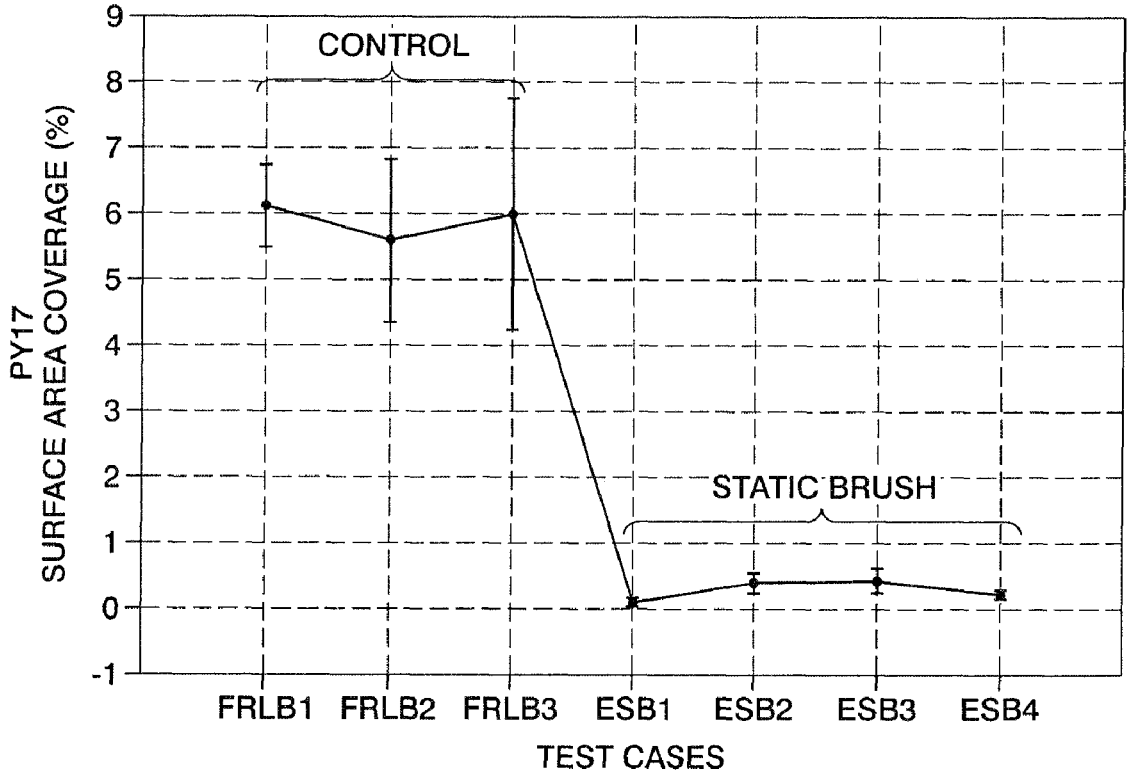
FIG. 4 is a graph depicting a reduction in yellow pigment contamination after a number of uses of a fuser roll.

FIG. 4 is a graph depicting a reduction in yellow pigment contamination after a number of uses of a fuser roll. The measurements contained in FIG. 4 were obtained using the Fourier transform infrared (FTIR) method as known in the art. The vertical axis depicts a surface area coverage percentage of pigment yellow 17 (PY17) on the fuser roll. As depicted, the higher the percentage of PY17 on the vertical axis, the larger coverage there is of PY17 on the fuser roll. The horizontal axis lists seven (7) test cases, with three (3) of the test cases, namely, FRLB1, FRLB2, and FRLB3 being the control test cases without employing a grounded static brush, and four (4) of the test cases, namely, ESB1, ESB2, ESB3, and ESB4 being the test cases employing the grounded static brush as described herein. The data from the seven cases as depicted in FIG. 4 was obtained after 25,000 impressions of the fuser roll.

As shown in FIG. 4, the three control cases without the grounded static brush yielded an average PY17 contamination value of about 6% area coverage. In contrast, the four test cases employing the grounded static brush yielded an average PY17 contamination value of about just over 0%. Accordingly, the test cases employing the grounded static brush reduced the average PY17 contamination value by about almost 6% compared to the control test cases.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of reducing contamination build-up in a fuser roll system comprising:

providing a donor roll and a fuser roll, wherein the donor roll is in rotational combination with the fuser roll; and reducing contamination on the fuser roll by positioning a grounded static brush to neutralize static charge on a surface of the donor roll, wherein the grounded static brush is positioned with a gap between the static brush and the donor roll.

2. The method of claim 1, wherein reducing contamination on the fuser roll comprises reducing toner resin, offset, gelled oil, pigment staining, and Zinc Fumarate.

3. The method of claim 1, further comprising:

providing one or more additional grounded static brushes.

4. The method of claim 3, wherein the one or more additional grounded static brushes are positioned adjacent to the grounded static brush.

5. The method of claim 3, further comprising:

reducing contamination on the fuser roll by positioning the one or more additional grounded static brushes to neutralize static charge on the fuser roll, wherein the one or more additional grounded static brushes are positioned with a gap between the one or more additional grounded static brushes and the fuser roll.

6. The method of claim 1, further comprising:

transferring a release agent from the donor roll to the fuser roll.

7. The method of claim 1, wherein the gap is in a range of about 1-20 millimeters.

8. A fusing system comprising:

a donor roll in rotational combination with a fuser roll; and a grounded static brush configured to reduce contamination on the fuser roll by neutralizing static charge on a surface of the donor roll, wherein the grounded static brush is positioned with a gap between the grounded static brush and the donor roll.

9. The system of claim 8, wherein the grounded static brush is further configured to reduce a pigment on the fuser roll by neutralizing the static charge on the surface of the donor roll.

10. The system of claim 8, further comprising one or more additional grounded static brushes.

11. The system of claim 10, wherein the one or more additional grounded static brushes are positioned adjacent to the grounded static brush.

12. The system of claim 10, wherein the one or more additional grounded static brushes are configured to neutralize static charge on a surface of the fuser roll, and wherein the one or more additional grounded static brushes are positioned with a gap between the one or more additional grounded static brushes and the fuser roll.

13. The system of claim 8, wherein the donor roll is configured to transfer a release agent to the fuser roll.

14. The system of claim 8, wherein the gap is in a range of about 1-20 millimeters.

15. A method of reducing contamination build-up in a fuser roll system comprising:

receiving a toner release agent onto a donor roll in rotational combination with a fuser roll;

transferring the toner release agent from the donor roll to the fuser roll;

reducing contamination on the fuser roll by positioning a grounded static brush to neutralize static charge on a surface of the donor roll, wherein the grounded static brush is positioned with a gap between the grounded static brush and the donor roll.

16. The method of claim 15, wherein reducing contamination on the fuser roll comprises reducing a pigment on the fuser roll.

17. The method of claim 15, wherein one or more additional grounded static brushes are positioned with a gap between the one or more additional grounded static brushes and the donor roll.

18. The method of claim 15, wherein the toner release agent is organomodified silicone oil.

19. The method of claim 15, wherein the gap is in a range of about 1-20 millimeters.

20. The method of claim 15, wherein the donor roll receives the toner release agent from a metering roll.

* * * * *